US005966741A

United States Patent [19]

Klecina

[11] Patent Number: 5,966,741

[45] Date of Patent: Oct. 19, 1999

[54] STACKED DISPOSABLE PLASTIC GLOVE PAD

[76] Inventor: Miro Klecina, 1780 First Ave., Suite 3F, New York, N.Y. 10128

[21] Appl. No.: 09/085,043

[22] Filed: May 27, 1998

[51] Int. Cl.[6] ..... A41D 19/00; B65D 85/18

[52] U.S. Cl. ..... 2/169; 2/159; 2/161.6

[58] Field of Search ..... 2/159, 158, 168, 2/169, 16, 160, 161.6, 161.7, 167; 206/554; 221/45, 26, 33

[56] References Cited

U.S. PATENT DOCUMENTS

| | | | |
|---|---|---|---|
| 3,229,875 | 1/1966 | Stoller | 2/239 |
| 4,046,257 | 9/1977 | Lechmacher | 206/554 |
| 4,557,384 | 12/1985 | Membrino | 206/554 |
| 4,928,322 | 5/1990 | Bradfield | 2/169 |
| 5,025,503 | 6/1991 | O'Brien | 2/163 |
| 5,119,968 | 6/1992 | Palmer | 221/26 |
| 5,524,762 | 6/1996 | Shafran et al. | 206/554 |
| 5,655,682 | 8/1997 | Hoffrichter | 221/45 |
| 5,788,080 | 8/1988 | Sill et al. | 206/554 |
| 5,806,099 | 9/1998 | Grinberg | 2/159 |

FOREIGN PATENT DOCUMENTS

| | | | |
|---|---|---|---|
| 2542980 | 9/1984 | France | 2/158 |

*Primary Examiner*—Amy Vanatta

[57] ABSTRACT

The instant invention provides an article of manufacture that includes: a generally flat planar stacked pad of at least two contiguously supertransposed disposable plastic gloves, each having a generally straight perforated weakened tear line above and generally transverse to the wrist portion of each of the gloves; and, a heat fused portion of the pad substantially adjacent to the perforated weakened tear line opposite the gloves sufficient to produce a substantially rigid single layer of plastic. The substantially rigid single layer further includes: an arrangement for mounting the article on a surface selected from the group consisting of a hole formed through the substantially rigid single layer, double sided adhesive pads mounted on the substantially rigid single layer or the combination of a hole and double sided adhesive pads; and, a label including printed indicia affixed to it.

10 Claims, 2 Drawing Sheets

STACKED DISPOSABLE PLASTIC GLOVE PAD

BACKGROUND OF THE INVENTION

In the broadest sense, the instant invention relates to a method of manufacture and an article made from that method. In a narrower sense, the invention relates to a method of manufacturing a pad of gloves and a method of its manufacture. In the narrowest sense, the invention relates to a pad of contiguously stacked disposable plastic gloves and its method of manufacture.

Disposable plastic gloves and the like have long been known in the prior art. In general, such as shown by U.S. Pat. No. 1,731,340 which teaches a toilet tissue paper mitt. U.S. Pat. No. 2,976,540 teaches a plastic, disposable physician's examination hand mitt having a grasping tab. An oversized, protective covering for the hands is seen in U.S. Pat. No. 2,773,264. U.S. Pat. No. 3,681,784 granted on Aug. 8, 1972 to Lindley is one example of just such art. Still another example of the prior art is disclosed in U.S. Pat. No. 3,384,083 granted on May 21, 1968 to Cozza, et al. In this last mentioned patent a disposable plastic glove is formed with a medicant formed integrally with one of the inner surfaces thereof and the glove is positioned on a paper backing sheet. U.S. Pat. No. 4,993,589 to McLaughlin teaches a dispensing apparatus for disposable, thin plastic articles. The articles, such as disposable plastic gloves, may be retrieved by the user one at a time in a relatively simple manner. The apparatus includes a box-like, generally rectangular enclosure for housing a removably mounted packet containing a plurality of the disposable articles stacked in the packet in closely spaced, parallel relationship in a flat condition. The enclosure is provided with a front window or opening and a removable top cover or cap. The packet of articles is loaded into the enclosure through the top opening and are disposed to be removed, one at a time, through the front opening of the enclosure. The packet comprises a pair of faces yieldably connected to one another which have a planar configuration at least as great as the area of the articles disposed between them. The enclosure also includes a spring to support the faces of the packet carrying the articles in a parallel relationship to the walls of the enclosure with the faces and the articles being biasly urged toward the front window to conveniently present the outermost article to the user. U.S. Pat. No. 4,034,853 to Smith teaches disposable plastic film gloves that are prepared from strip film material in two layers which are heat sealed in the outline of the five fingers of a glove and simultaneously die cut to remove the material between the fingers and to the side and base of the respective gloves. The gloves are formed in a strip with the three center fingers of each glove fitting the curved base or wrist opening of then adjacent glove. The heat seal at the fingers adjacent to the wrist opening of the next glove is arranged with a perforation or serration outside the heat sealed portion in the wrist portion of the succeeding glove. This structure permits a strip of gloves to be rolled or provided in reversed overlapping layers for continuous dispensing and permits each glove to be pulled off from the succeeding one with all of the intermediate portions cut out and the wrist opening completely open and ready for use. U.S. Pat. No. 3,870,150 to Hummel teaches a disposable sterile packaged plastic glove and a container therefor, that are formed in a single operation. A plastic glove formed of two opposed plastic film sheets is sealed to the same supporting member. The package, when opened, serves as a disposable receptacle for the used glove. The package also provides a convenient means for the user to insert his hand into the glove. U.S. Pat. No. 4,476,588 to Long teaches a disposable hand care product that includes a first and second glove side elements fabricated of a relatively thin plastic film material. Each of these elements have oppositely extending finger receiving areas and juxtapositioned palm receiving areas. These side elements are disposed in face-to-face aligned relationship. They are sealingly interconnected to one another around the entire periphery thereof so as to define a pair of glove members arranged in wrist-to-wrist connected relationship. A hand care product is disposed interjacent these side elements. Separating means permits convenient separation of the pair of glove members from one another while simultaneously providing access into the interior of the member. In this manner, a person can insert his or her hands into these members so as to have skin contact with the hand care product disposed inside it. U.S. Pat. No. 4,677,697 to Hayes teaches a disposable plastic clean up glove that is economical to manufacture and easy to use. It is made from two sheets of thermo setting plastic sheets joined together by heat sealing into shape and perforated for easy detachment. A fastener cut extends along the outside of the cuff portion and a tie strip extends along the fastener. Once an object is picked up using the glove, the glove is turned inside out to form a container and the fastener closed. The tie strip may be closed for double security and an aroma bubble located on the outside of the glove, now inside of the container, is burst to disinfect and deodorize the held contents. U.S. Pat. No. 5,088,620 to Kelliher teaches a dispenser for gloves. The dispenser includes a tubular body having a first end and a second end and having a spring disposed within it. The spring is secured to a moveable disc shaped member. A flexible mammillated shaped element having a first end and a second end is secured to the disc shaped member at the first end and secures a plurality of gloves within it. The second end of the mammillated member is secured to the second end of said tubular body. A top element which slideably fits over the second end of the tubular body has an opening within and a diaphragm element having an aperture within, secured over said opening. The spring urges the disc shaped member against the flexible mammillated shaped member containing the gloves allowing removal of one glove at a time from the aperture in the diaphragm element. Another type of glove dispenser is disclosed in U.S. Pat. No. 4,773,532 issued to Stephenson. In this invention, a package of flattened sterile surgical gloves was provided in a roll form. The roll of gloves consisted of a continuous spirally wound sheet having uniformly spaced parallel transverse tear lines. The gloves were attached by adhesive to the sheet. Although useful in some limited applications such dispensing system suffered significant limitations due to the inability of the user to mount the gloves on such sheet, that is, such sheet had to be purchased preformed, with the gloves adhered thereto by adhesive. Furthermore, such roll dispensers resulted in a greater overall cost to the user in that for each glove dispensed a sheet of plastic and adhesive was also dispensed along with the glove, which then had to be discarded as a waste product of this dispensing system. Another prior patent teaches an overglove and made of thin plastic designed to keep women's dress glove clean and could not be used in a healthcare situation: see WOMAN'S OVERGLOVE OR THE LIKE, U.S. Pat. No. 2,972,748 patented Feb. 28, 196. PROTECTIVE COVER FOR THE HANDS, U.S. Pat. No. 2,773,264 patented Dec. 11, 1956, teaches a disposable three fingered food handler's glove made of thin plastic. DISPOSABLE GLOVE OR MITT FOR SELF-SERVICE GASOLINE U.S. Pat. No. 4,745,635 patented May 24, 1988, teaches a disposable is a plastic glove to keep one's hands clean when pumping gas. Yet another prior art disposable glove similar to the above mentioned prior art is by the same inventor: DISPOSABLE GLOVE OR MITT FOR SELF-SERVICE GASOLINE AND FROZEN FOOD HANDLER, U.S. Pat. No. 4,918,755 patented Apr. 24, 1990. U.S. Pat. No. 5,020,160 to Cano teaches a protective, disposable hand covering or mitt having a tear line along at least a portion of the body thereof to provide controlled tearing and destruction of the glove to facilitate its removal. A mechanism such as a textured area, tab, hole, handle or the like may optionally be provided adjacent the tear line to assist in predictably tearing away the glove. The hand covering may be of plastic or paper or the like and should be of ambidextrous and somewhat oversized design, optionally with a flared cuff. Another optional feature is an inverted cuff to channel away any undesired liquid or other substance that may drip down the glove. Such hand coverings may find uses at self-service gasoline or fuel stations, in health care fields such as medicine and dentistry, in clean room manufacture, domestic cleaning and gardening and the like.

Similarly, methods of manufacturing disposable plastic gloves are well known in the prior art. For instance, U.S. Pat. No. 3,923,577 to Baab teaches an apparatus and method for manufacturing a multi-component article. The article is includes a support layer in the form of a sheet such as paper, toweling or the like, on which is superimposed a plurality of heat sealed products such as disposable plastic gloves, shoe covers, bags, hats, etc. The apparatus and the include means for concurrently feeding a plurality of heat sealable plastic sheets and a layer of paper and means for successively forming the multiple layers of articles that are secured to the paper backing. U.S. Pat. No. 3,866,245 to Sutherland teaches a plastic glove and a method of making same. The Sutherland invention includes a preformed liner located between two plastic films which are subsequently sealed along the seal line disposed outwardly from the liner to the required contour of the side edges of the glove. U.S. Pat. No. 3,920,500 to Brieske teaches flexible plastic structures and a method for producing the structures. Plastic sheets are employed for forming four film layers, and heat sealing means secure the films around peripheral portions thereof whereby the films define an assembly having the shape of a puppet, a glove or other type article. A perforated line is formed adjacent one edge of the assembly of four films, and when a strip is torn away along this line, free edges of the films are exposed. The films are then adapted to be separated into separate pairs, and each pair then serves independently, for example, as a glove for one hand. U.S. Pat. No. 4,928,322 to Bradfield teaches a method of converting sheet material into gloves consisting of the steps of arranging sheet material with two inner plies of thermoplastic between outer plies of tissue. Then, applying heat to one of the outer plies of tissue in the outline of a glove, such that the inner plies of thermoplastic bond the plies of sheet material together to form a glove with an opening along one side to permit hand entry. An apparatus for use in converting sheet material into gloves consisting of a body and an electrically heated metal plate mounted on the body with at least one opening in the shape of a glove. "C" clamps are hinged to the body such that the body may be mounted to a thermally insulated surface and moved between a position where the plate engages the surface, and a position where the plate is spaced from the surface. A disposable glove consisting of two inner plies of thermoplastic sheet material between outer plies of tissue sheet material, sealed together to form a glove with an opening along one side to permit hand entry.

Despite the foregoing plethora of prior art, there nonetheless exists for a long felt need for a simple, inexpensive, generally flat planar stacked pad of continuously supertransposed disposable plastic gloves, each having a generally straight perforated weakened tear line above and generally transverse to the wrist portion of each of the gloves; and, an improved arrangement for fixing the individual glove members together that includes a heat fused portion of the pad substantially adjacent to the perforated weakened tear line opposite the gloves sufficient to produce a substantially rigid single layer of plastic thereof

SUMMARY OF THE INVENTION

The instant invention in large part solves the problems of the prior and fulfills a long felt need by providing an article of manufacture that includes a simple, inexpensive, generally flat planar stacked pad of contiguously supertransposed disposable plastic gloves.

Also contemplated by the invention is a process for manufacturing article.

Here are the more important features of the invention as broadly outlined, in order that the detailed description that follows may be better understood; and in order for the present contribution to the art may be better appreciated. There are additional features of the invention that will be described hereinafter and which form the subject matter of the appended claims. Those of ordinary skill in the art will appreciate that the conception upon which this disclosure is based may readily be utilized as a basis for the designing of other structures, methods and systems for carrying out the several purposes of the instant invention. It is important, therefore, that the claims be regarded as including such equivalent constructions insofar as they do not depart from the spirit and scope of the instant invention.

Further, the purpose of the instant abstract is to enable the U.S. Patent and Trademark office and the public generally, and especially the scientists, engineers and practitioners in the art who are not familiar with patent or legal terms or phraseology, to determine quickly from a cursory inspection of it, the technical disclosure of the patent application. The abstract is neither intended to define the invention of the instant patent application, which is measured by the claims, nor is it intended in any manner to be limiting as to the scope of the instant invention.

In light of the foregoing, it is therefore an object of the instant invention to provide a new and improved article and method for manufacturing the article, that has all of the advantages of the prior art and none of its disadvantages.

It is another object of the instant invention to provide a new and improved article of manufacture which may be easily and efficiently manufactured and marketed.

It is another object of the instant invention to provide a new and improved article of manufacture that is of a durable and reliable construction.

It is another object of the instant invention to provide a new and improved article of manufacture which can be manufactured at low cost with regard to both labor and materials, and which accordingly can be sold at a correspondingly lower cost, thus promoting commerce.

It is a further object of the instant invention to provide a new and improved a simple, inexpensive, generally flat planar stacked pad of contiguously supertransposed disposable plastic gloves which provides at least some of the advantages of the prior art schemes, while simultaneously eliminating at least some of the disadvantages of them.

Other objects, features, and advantages of the instant invention, in its details of construction and arrangement of parts, will be seen from the above, from the following description of the preferred embodiment when considered in light of the drawings and the appended claims.

DETAILED DESCRIPTION OF THE INVENTION

THE ARTICLE

Figure 1:
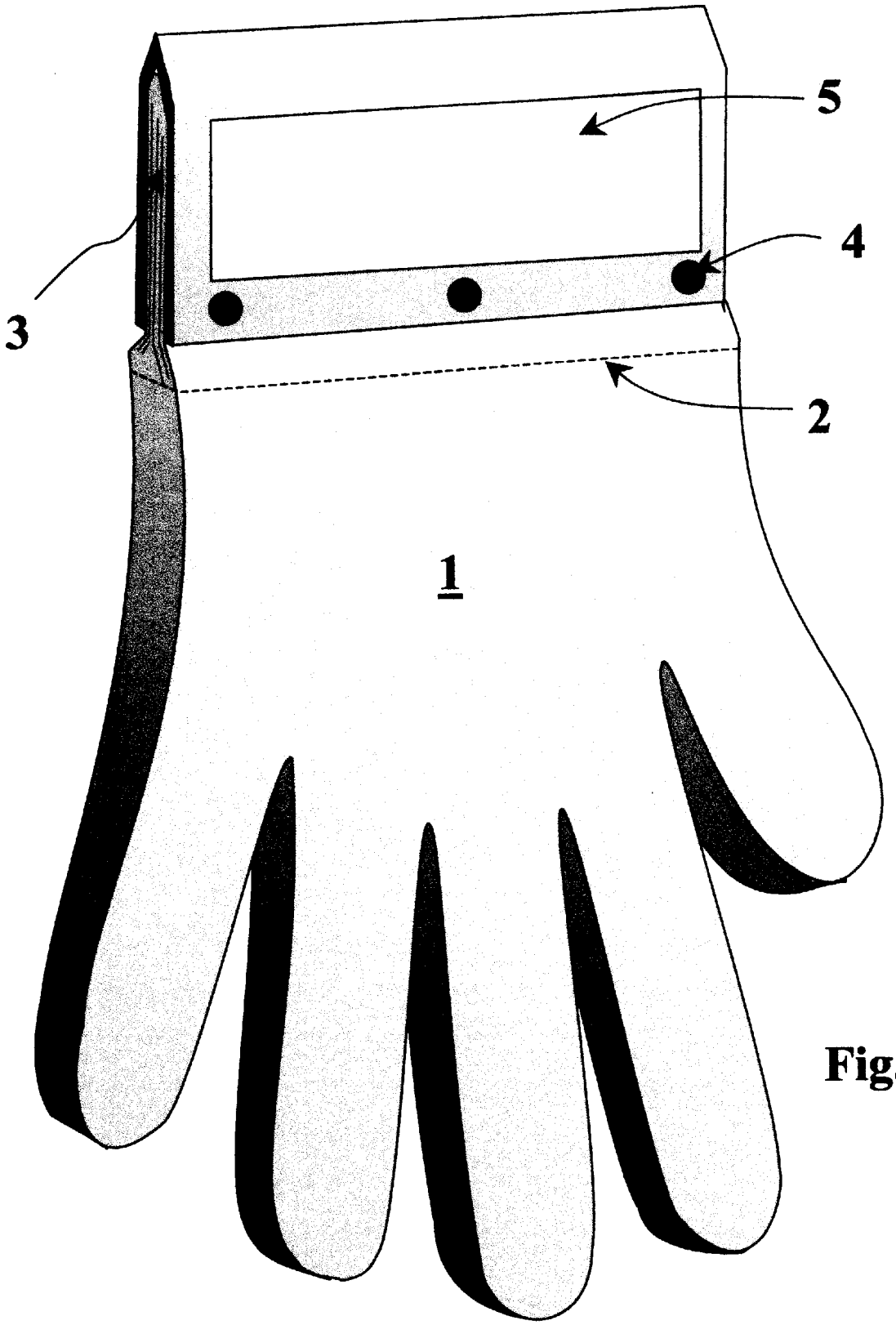
FIG. 1 shows a first embodiment of the article of the invention.

FIG. 1 shows the article of manufacture of the instant invention. Depicted is a generally flat planar stacked pad 1 of a plurality of contiguously supertransposed disposable plastic gloves. Each individual glove has a generally straight perforated weakened tear line 2 above and generally transverse to the wrist portion thereof The pad 1 has a heat fused portion 3 substantially adjacent to the perforated weakened tear line 2 opposite the gloves sufficient to produce a substantially rigid single layer of plastic of it. The substantially rigid single layer also includes an arrangement for mounting the article on to a surface selected from the group consisting of. a hole 4 formed through the substantially rigid single layer, at least one at least one double sided adhesive pad (not depicted) mounted on the substantially rigid single layer and combinations of them. The surface may be vertical or horizontal or inclined at any angle therebetween. Optionally, the pad includes a label 5 affixed to it, including printed indicia.

Figure 2:
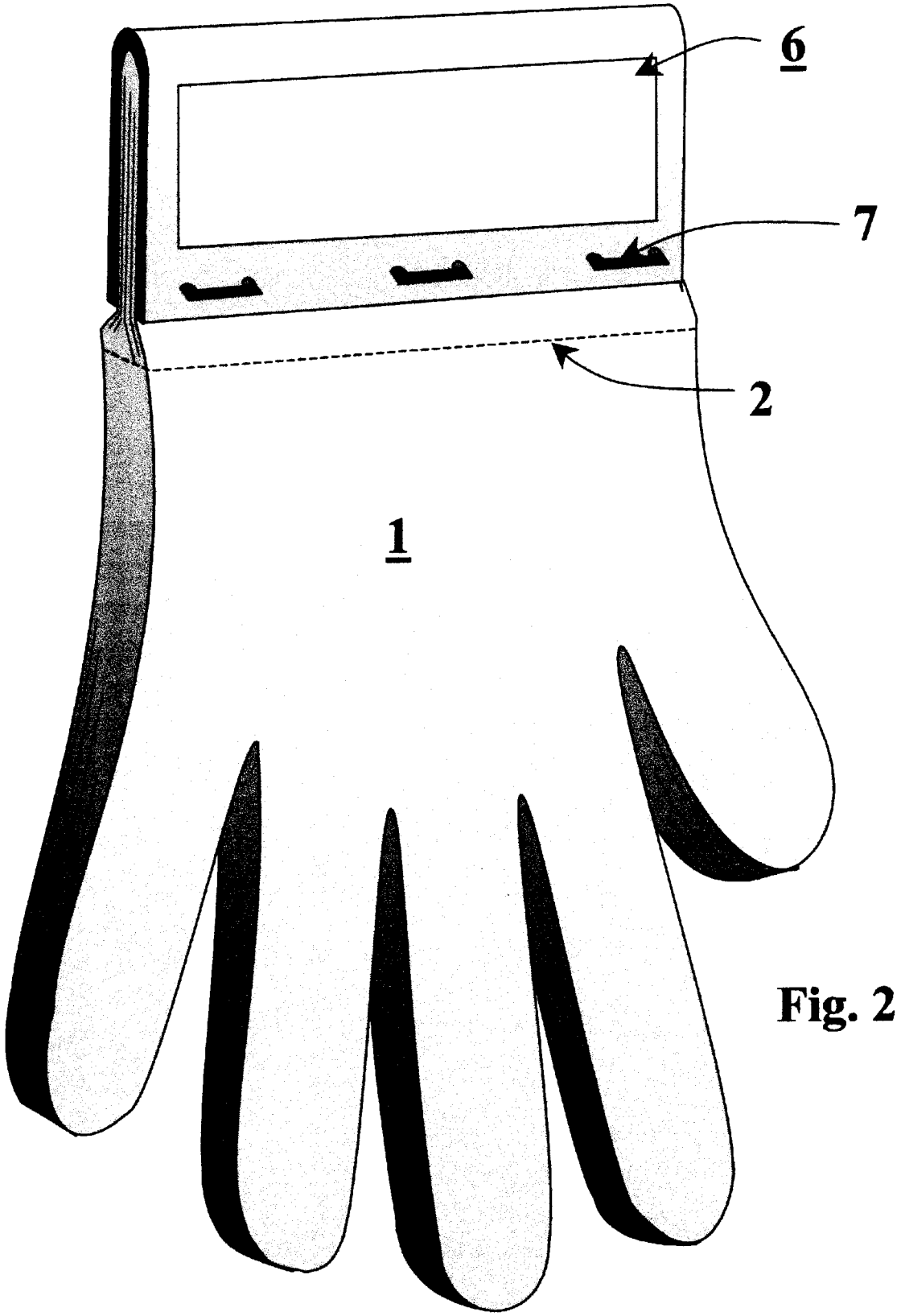
FIG. 2 shows a second embodiment of the article of the invention.

FIG. 2 shows an alternative embodiment of the article of manufacture of the instant invention. As in the case of FIG. 1, depicted is a generally flat planar stacked pad 1 of a plurality of contiguously supertransposed disposable plastic gloves. Each individual glove has a generally straight perforated weakened tear line 2 above and generally transverse to the wrist portion thereof However, as an alternative to the heat fused portion 3 of FIG. 1, a generally rectangular stapled flap 6 extending from the wrist end of the pad to substantially adjacent to the perforated weakened tear line 2 opposite the gloves sufficient to bind all gloves of the pad 1 together into a single unit. Staples 7 are the preferred means to secure flap 6 to pad 1. The portion of pad 1 secured by flap 6 also includes an arrangement for mounting the article on to a surface. The arrangement is selected from the group consisting of at least one hole 4 formed through the flap and pad, at least one at least one double sided adhesive pad (not depicted) mounted on the substantially rigid single layer and combinations of them. The surface may be vertical or horizontal or inclined at any angle therebetween. Optionally, the pad 6 includes printed indicia.

USING THE ARTICLE

Use of the instant article of manufacture is very simple. The user simply fixes the pad to a vertical or horizontal surface (or any other surface having an angle therebetween) in or near an area or activity that requires disposable plastic gloves. After the pad is so fixed, the user simply tears one or more of the gloves and applies them to an intended activity. These activities typically include uses at self-service gasoline or fuel stations, in health care fields such as medicine and dentistry, in bakeries and other food handling operations, in clean room manufacture, domestic cleaning and gardening and the like.

MANUFACTURING THE ARTICLE

Plastic gloves are widely used where disposable gloves are required because of their economy, their inertness to a wide range of chemicals and their flexibility over a wide range of temperatures. In light gauges, around one ml, they provide excellent touch sensitivity. With the heat sealed seams intact, they are waterproof, have adequate grease and oil resistance for gloves, and they are impervious to most common, water-based chemical cleaning solutions. Although polyethylene is the preferred material of construction, where special protection is needed, other thermoplastic films, such as polypropylene, polybutylene, polyamides, ethylene/vinyl-acetate copolymer, polyvinyl chloride, polyvinylidine chloride, and many others.

Whatever material of construction is used, this type of glove owes much of its economy to the fact that the seams are heat sealed rather than sewn, as in a conventional cloth or leather glove. A common way of making disposable plastic gloves is to fold a film double as it is drawn off the roll, with the line of the fold in the machine direction, then to pass the double layer of plastic into a reciprocating heat seal and cut out die, where the glove seams are made and the glove is cut out, all in one single, rapid motion. Given the economy of heat sealing compared to other methods of making seams, it is virtually mandatory that disposable gloves be made by heat sealing. Added economy of manufacture is achieved by employing the above described heat fused portion 3 to fix all of the individual gloves of the pad to each other.

The greatest single disadvantage of this type of glove is its tendency to stick to the skin when even a small amount of perspiration is present. Since a majority of the jobs where the gloves are used require some physical exertion, perspiration is usually inevitable. Moreover, the moisture barrier properties of the plastic ensures that any perspiration generated does not dry off readily. The end result is that the glove is stuck to the hand, and is so difficult to remove that it is often torn in the removal process. This characteristic of the glove is so irritating that it severely limits the saleability of these gloves.

Various means are used to try to alleviate this problem. Gloves are commonly dusted with starch or talc powder to improve their slip. Also, gloves are made deliberately large to make them easier to put on and take off.

Many combinations of plastic material may be used to practice the invention. Exemplary, but by no means exclusive of such plastics materials are: polyethylene, polypropylene, polybutylene, polyamides, ethylene/vinyl-acetate copolymer, polyvinyl chloride, polyvinylidine chloride, and many others. Various films could be combined to provide two or more layers for special purposes, for example, a high coefficient of friction material such as ethylene/vinylacetate copolymer film could be bonded to polyethylene film to give a special purpose glove material. Also films made from blends of different resins, or films of copolymers of different resins would be advantageous for certain applications.

Where very good touch sensitivity was required, the liner can be cut back from the finger tip area without detracting seriously from the ability to remove the glove.

The steps used to manufacture the article of the instant invention include:

a. Forming a two-ply liner web consisting of a two-ply longitudinally extending portion and a plurality of two-ply hand shaped portions. Each of the hand shaped portions have distinct finger portions and a cuff portion, and each of the cuff portions are integrally connected to a ply of the longitudinally extending portion such that the hand portions project laterally from the longitudinally extending portions at spaced intervals along its length;

b. Optionally providing a two-ply liner web may be interposed between overlapping films of thermoplastic material;

c. Detaching individual gloves from the remainder of the laminate by severing the films along a line spaced outwardly from the seal line and by severing the hand shaped portions of the liner from the longitudinally extending portion thereof along a line extending across the cuff portion and bonding the overlapping films of thermoplastic material to one another along a seal line disposed outwardly from the edges of the hand shaped portion to form a laminate;

d. Stacking the individual gloves in a contiguous pile;

e. Attaching all of the gloves together either by heat sealing the pile to form the substantially rigid heat fused portion described above or applying the stapled flap as described above;

f. Optionally providing the surface mounting holes in the substantially rigid heat fused portion or stapled flap portion;

g. Optionally fixing two sided adhesive surface mounting pads to the substantially rigid heat fused portion stapled flap portion; and, h. Optionally providing the substantially rigid heat fused portion or stapled flap portion with printed indicia. In the case of the substantially rigid heat fused portion, printed indicia can be provided through a printed label that has an adhesive of its back surface.

As an alternative to labeling, the substantially rigid heat fused portion may embossed with printed indicia during the above mentioned heat fusing step.

Although the invention has been described with reference to certain preferred embodiments, it will be appreciated that many variations and modifications may be made within the scope of the broad principles of the invention. Hence, it is intended that the preferred embodiments and all of such variations and modifications be included within the scope and spirit of the invention, as defined by the following claims.

I claim:

1. A process for manufacturing an article, consisting essentially of:

providing a generally flat planar stacked pad of at least two contiguously supertransposed disposable plastic gloves, each including a thumb and four fingers and having a generally straight perforated weakened tear line above and generally transverse to the wrist portion of each of said gloves; and, attaching all of said disposable plastic gloves of said generally flat planar stacked pad to each other at least at one point located on said pad opposite said each generally straight perforated weakened tear line from each of said disposable plastic gloves with a structural arrangement by a step of either:

heat fusing the portion of said pad substantially adjacent to said perforated weakened tear line opposite said gloves sufficient to produce a substantially rigid single layer of plastic thereof; or, stapling a generally rectangular folded flap to that portion of said pad extending from the wrist end of the pad to substantially adjacent to each said perforated weakened tear line opposite each of said gloves; wherein all of said gloves of said pad are bound together into a single unit.

2. The process of claim 1 wherein said heat fusing further comprises providing a hole through said substantially rigid single layer.

3. The process of claim 1 wherein said stapling further comprises providing at least one double sided adhesive pad mounted on said substantially rigid single layer.

4. The process of claim 1 further comprising:

providing printed indicia on said structural arrangement.

5. The article produced from the process of claim 1.

6. An article of manufacture, consisting essentially of:

a generally flat planar stacked pad of at least two contiguously supertransposed disposable plastic gloves, each including a thumb and four fingers and having a generally straight perforated weakened tear line above and generally transverse to the wrist portion of each of said gloves; and, a structural arrangement for attaching all of said gloves of said pad to each other, consisting of either:

a heat fused portion of said pad substantially adjacent to said perforated weakened tear line opposite said gloves sufficient to produce a substantially rigid single layer of plastic thereof; or, a generally rectangular folded flap stapled to that portion of said pad extending from the wrist end of the pad to substantially adjacent to each said perforated weakened tear line opposite each of said gloves.

7. The article of claim 6 wherein said heat fused portion further comprises a hole formed through said substantially rigid single layer.

8. The article of claim 6 wherein said generally rectangular folded flap further comprises at least one double sided adhesive pad mounted on said substantially rigid single layer.

9. The article of claim 6 further comprising:

fixing a label including printed indicia on said structural arrangement.

10. An article of manufacture, consisting of:

a generally flat planar stacked pad of at least two contiguously supertransposed disposable plastic gloves, each including a thumb and four fingers and having a generally straight perforated weakened tear line above and generally transverse to the wrist portion of each of said gloves; and, a structural arrangement for attaching all of said gloves of said pad to each other, consisting of either:

a heat fused portion of said pad substantially adjacent to said perforated weakened tear line opposite said gloves sufficient to produce a substantially rigid single layer of plastic thereof; or, a generally rectangular flap stapled to that portion of said pad extending from the wrist end of the pad to substantially adjacent to each said perforated weakened tear line opposite each of said gloves;

wherein said structural arrangement further comprises:

an second structural arrangement for mounting said article on a surface selected from the group consisting of:

at least one hole formed therethrough; and, at least one at least one double sided adhesive pad mounted thereon and combination thereof.

* * * * *